US007598935B2

(12) United States Patent
Kim

(10) Patent No.: US 7,598,935 B2
(45) **Date of Patent: *Oct. 6, 2009**

(54) LIGHT EMITTING DEVICE WITH CROSS-TALK PREVENTING CIRCUIT AND METHOD OF DRIVING THE SAME

(75) Inventor: Ji Hun Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 312 days.

This patent is subject to a terminal disclaimer.

(21) Appl. No.: 11/410,086

(22) Filed: Apr. 25, 2006

(65) Prior Publication Data

US 2006/0262049 A1 Nov. 23, 2006

(30) Foreign Application Priority Data

May 17, 2005 (KR) ..... 10-2005-0041238
May 17, 2005 (KR) ..... 10-2005-0041241

(51) Int. Cl.
*G09G 3/30* (2006.01)

(52) U.S. Cl. ..... 345/78

(58) Field of Classification Search ..... 345/76–83, 345/204

See application file for complete search history.

(56) References Cited

U.S. PATENT DOCUMENTS

| | | | | |
|---|---|---|---|---|
| 4,982,183 | A | 1/1991 | Flegal et al. | 340/781 |
| 5,946,068 | A | 8/1999 | Lee et al. | |
| 6,710,548 | B2 | 3/2004 | Kimura | |
| 6,985,124 | B1 | 1/2006 | Nogawa | |
| 7,088,052 | B2 | 8/2006 | Kimura | |
| 2002/0167474 | A1 | 11/2002 | Everitt | |
| 2003/0076048 | A1* | 4/2003 | Rutherford | 315/169.3 |
| 2003/0142088 | A1* | 7/2003 | LeChevalier | 345/211 |
| 2004/0196275 | A1 | 10/2004 | Hattori | |
| 2004/0207615 | A1* | 10/2004 | Yumoto | 345/211 |
| 2004/0239661 | A1 | 12/2004 | Jo | 345/204 |
| 2005/0001792 | A1 | 1/2005 | Watanabe et al. | 345/55 |
| 2005/0099367 | A1 | 5/2005 | Kang et al. | |

FOREIGN PATENT DOCUMENTS

| | | | |
|---|---|---|---|
| EP | 1 227 467 | A3 | 7/2002 |
| JP | 05-216425 | | 8/1993 |
| JP | 11-272229 | | 10/1999 |
| JP | 2001-109433 | | 4/2001 |
| JP | 2003-005712 | | 1/2003 |
| JP | 2004-24667 | | 9/2004 |
| JP | 2004-264667 | | 9/2004 |
| KR | 10-2002-0066209 | A | 8/2002 |
| KR | 10-2003-0022804 | A | 3/2003 |
| KR | 10-2004-0086164 | A | 10/2004 |
| KR | 10-2005-0032321 | A | 4/2005 |
| KR | 10-2005-0036238 | | 4/2005 |

* cited by examiner

*Primary Examiner*—Sumati Lefkowitz
*Assistant Examiner*—Robert E Carter, III
(74) *Attorney, Agent, or Firm*—Ked & Associates LLP

(57) ABSTRACT

A light emitting device and a method of driving the same are provided where a cross-talk problem can be overcome. The light emitting device includes a display panel including a plurality of scan lines disposed in a first direction, a plurality of data lines disposed in a second direction, wherein the second direction is different from the first direction, and a plurality of pixels that are defined as overlying areas of the plurality of scan lines and the plurality of data lines, and a cross-talk preventing circuit configured to provide the plurality of scan lines with compensating currents according to display data provided by an outside device.

23 Claims, 6 Drawing Sheets

LIGHT EMITTING DEVICE WITH CROSS-TALK PREVENTING CIRCUIT AND METHOD OF DRIVING THE SAME

BACKGROUND OF THE INVENTION

1. Field of the Invention

The present invention relates to a light emitting device and a method of driving the same, particularly relates to a light emitting device without cross-talk phenomenon and a method of driving such light emitting device.

2. Description of the Related Art

An organic electroluminescent device is a light emitting device, which emits light with a certain applied voltage thereto.

FIG. 1A is a block diagram illustrating an organic electroluminescent device; and FIG. 1B is an equivalent circuit diagram of some of the pixels of FIG. 1A.

Referring to FIG. 1A, an organic electroluminescent device is comprised of a panel 100, a scan driving circuit 102, a data driving circuit 106 and a controller 104.

The panel 100 includes a plurality of pixels E11 to E44 that are defined as overlying areas of data lines D1 to D4 and scan lines S1 to S4.

For example, the pixels E11 to E44 of the panel will emit light in the case that a voltage 20V is applied to the data lines D1 to D4 and a voltage 0V is applied to the scan lines S1 to S4.

In this case, some of the pixels E11 to E44 may not emit light for various reasons. For example, when some of the pixels E33 to E43 located on a third scan line S3 are set not to generate light at a certain time, the total current value passing through the third scan line S3 becomes less than the total current value passing through the other scan lines S1, S2 and S4.

Conventionally, the organic electroluminescent device provides the scan lines S1 to S4 with scan signals of the same low logic value, for example 0V, in sequence. Thus, it is appreciated that the same voltage, e.g. 20V is applied between the cathode and the anode of each pixel if the electroluminescent device normally operates.

However, in reality, different voltages are applied to the cathodes of the luminescent (luminescent) pixels because of the combined effect of the line resistance (for example 160Ω) of the scan lines and some non-luminescent pixels E33 and E43.

As a result, the voltages applied between the cathode and the anode of the pixels may be different from each other, and thus the pixels emit light at different luminance even though they are predetermined to have the same luminance value. Such phenomenon is referred to as cross-talk.

For example, let's assume that the total current passing through the first scan line S1 is 14 mA, and that of the third scan line S3 is 10 mA because of the non-luminescent pixels E33 and E34. Here, the first pixel E11 and the third pixel E13 are preset to emit light at the same luminance in a normal state.

In this case, since the line resistance of each scan line S1 to S4 is 160 Ω, the voltage difference between the cathode and the anode of the first pixel E11 on the first scan line S1 is 20V(Vcc)−0V(the voltage of the first scan signal)−2.24V(14 mA×160Ω, the voltage of the first scan line S1)=17.76V. In comparison, the voltage difference between those of the third pixel E13 on the third scan line S3 is 20V(Vcc)−0V(the voltage of the third scan signal)−1.6V(10 mA×160Ω, the voltage of the third scan line S3)=18.4V.

Namely, the voltage difference between the cathode and the anode of the luminescent pixels on the third scan line S3 is larger than the voltage difference of the pixels on the other scan lines S1, S2 and S4 which are preset to emit light at the same luminance. As a result, the luminescent pixels on the third scan line S3 emit light with higher luminance than the pixels on the other scan lines S1, S2 and S4 do.

In short, such luminance variation occurs adversely to the designer's intention between the pixels due to the above described cross-talk phenomenon.

Although the organic electroluminescent device is taken as an example in the foregoing description, the cross-talk is a common phenomenon encountered in other light emitting devices. Therefore, there is a need to develop a light emitting device and method of driving the same where such cross-talk problem may be solved.

SUMMARY OF THE INVENTION

The object of the present invention is to provide a light emitting device and a method of driving the same that can prevent the occurrence of cross-talk phenomenon.

In one aspect of the present invention, the present invention provides a light emitting device comprising a display panel including a plurality of scan lines disposed in a first direction; a plurality of data lines disposed in a second direction, wherein the second direction is different from the first direction; and a plurality of pixels that are defined as overlying areas of the plurality of scan lines and the plurality of data lines; and a cross-talk preventing circuit configured to provide the plurality of scan lines with compensating currents according to display data provided by an outside device.

In another aspect of the present invention, the present invention provides a light emitting device comprising a display panel including a plurality of scan lines including a plurality of first scan lines extending in a first direction; and a plurality of second scan lines extending in a second direction; a plurality of data lines disposed to cross with the plurality of scan lines; and a plurality of pixels that are defined as crossing areas of the plurality of scan lines and the plurality of data lines; and a cross-talk preventing circuit configured to provide the plurality of scan lines with compensating currents according to display data provided by an outside device, the cross-talk preventing circuit including a first cross-talk preventing circuit electrically coupled to the plurality of first scan lines and configured to provide the plurality of first scan lines with the compensating currents; and a second cross-talk preventing circuit electrically coupled to the plurality of second scan lines and configured to provide the plurality of second scan lines with the compensating currents.

In further another aspect of the present invention, the present invention provides a method of driving a light emitting device including a plurality of pixels that are defined as overlying areas of the plurality of scan lines and the plurality of data lines, the method comprising the steps of (a) receiving display data provided by an outside device; and (b) providing the plurality of scan lines with compensating currents according to the received display data.

In further another aspect of the present invention, the present invention provides a method of driving a light emitting device including a plurality of pixels that are defined as overlying areas of the plurality of scan lines including first scan lines and second scan lines and the plurality of data lines, the method comprising the steps of (a) receiving display data provided by an outside device; (b) providing the first scan lines with compensating currents according to the received display data; and (c) providing the second scan lines with compensating currents according to the received display data.

According to the present invention, the total current values passing through the scan lines all are made equal with the aid of the compensating currents that the cross-talk preventing circuits provide so that the cross-talk problem may be solved.

BRIEF DESCRIPTION OF THE DRAWINGS

These and other features, aspects and advantages of the present invention will become better understood with regard to the following description, appended claims, and accompanying drawings where:

DETAILED DESCRIPTION OF THE INVENTION

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

Hereinafter, the preferred embodiments of the present will be described in detail with reference to the accompanying drawings. In the following embodiments, the organic electroluminescent device is provided as an example of the light emitting device. It is, however, obvious that the teaching of the present invention is not limited to the organic electroluminescent device.

Figure 1A:
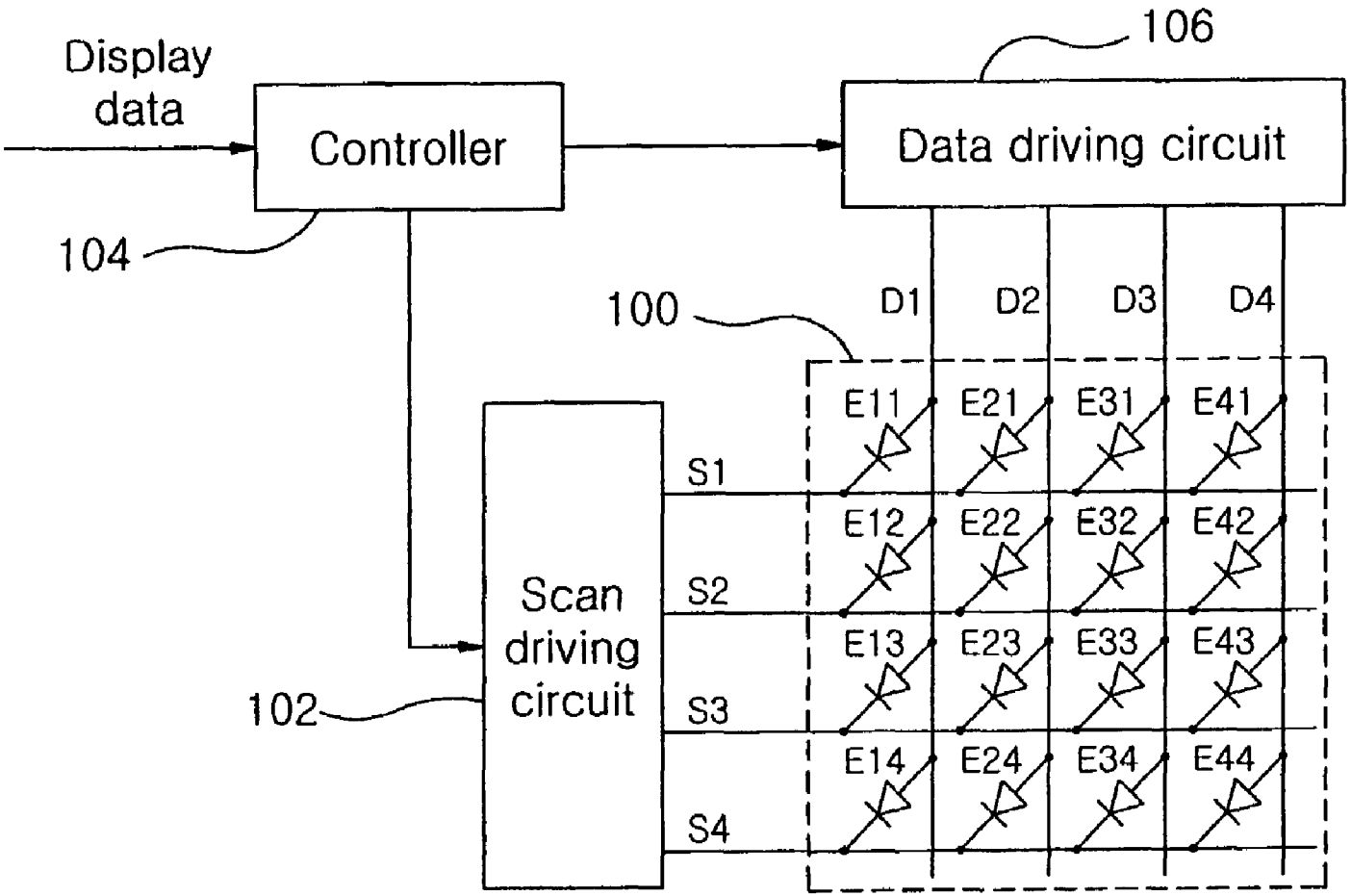
Fig. 1A [RELATED ART]
FIG. 1A is a block diagram illustrating an organic electroluminescent device.
Figure 1B:
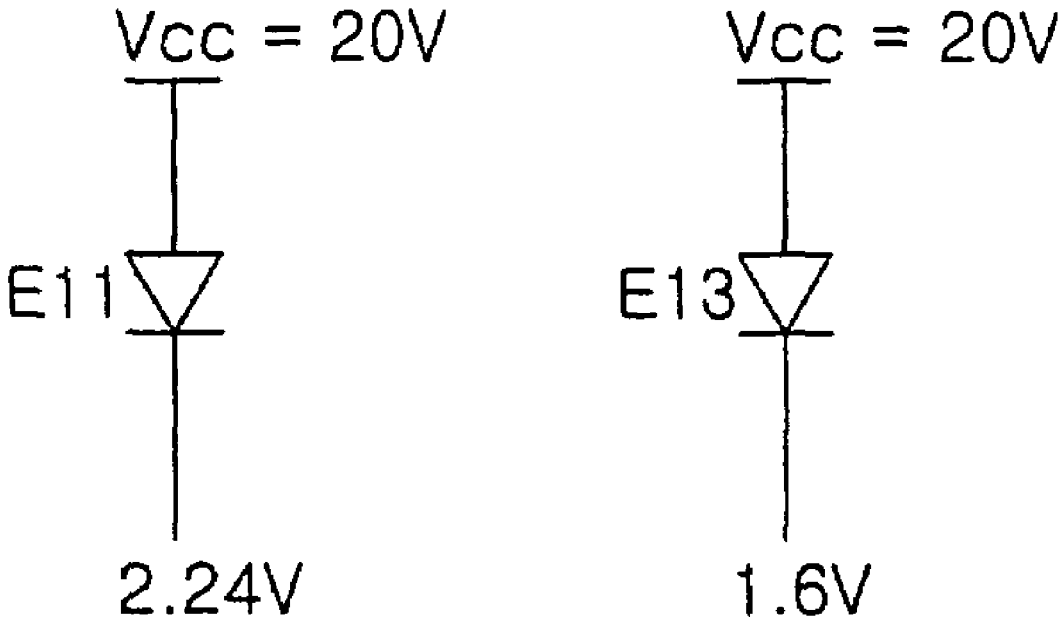
Fig. 1B [RELATED ART]
FIG. 1B is an equivalent circuit diagram of some of the pixels of FIG. 1A.
Figure 2:
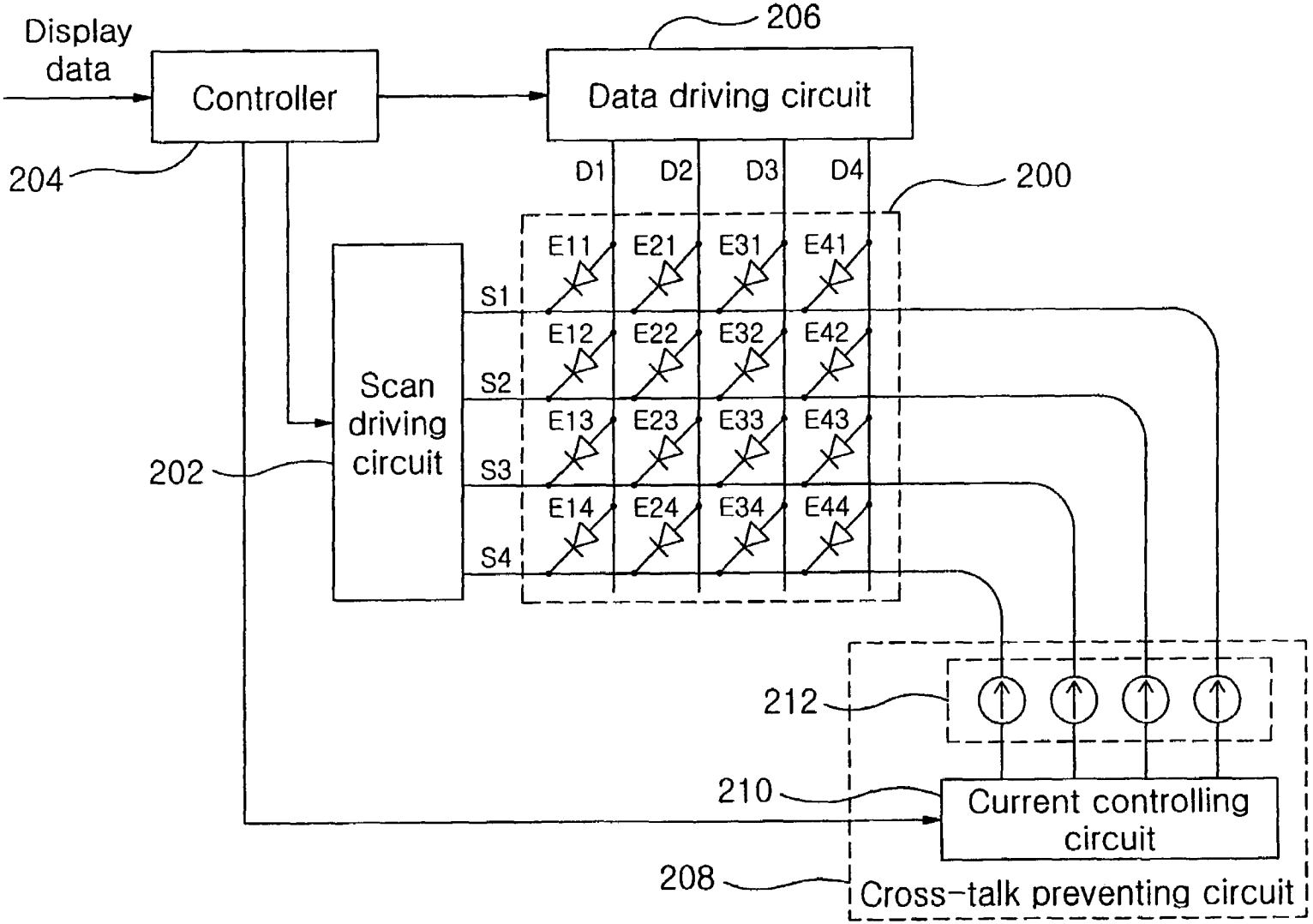
FIG. 2 is a block diagram illustrating an electroluminescent device according to one embodiment of the present invention.

FIG. 2 is a block diagram illustrating an electroluminescent device according to one embodiment of the present invention.

Referring to FIG. 2, the electroluminescent device of one embodiment of the present invention comprises a panel 200, a san driving circuit 202, a data driving circuit 206, a controller 204 and a cross-talk preventing circuit 208.

The panel 200 includes a plurality of pixels E11 to E44 that are defined as overlying areas of data lines D1 to D4 and scan lines S1 to S4.

Here, the scan lines S1 to S4 are extended in one direction. In other words, all scan lines S1 to S4 are connected to one scan driving circuit 202 at one side thereof, i.e. the left side in FIG. 2.

The scan driving circuit 202 transmits a plurality of scan signals to the scan lines S1 to S4 in sequence.

The data driving circuit 206 transmits to the data lines D1 to D4 data signals corresponding to display data provided through the controller 204.

When the data signals are transmitted to the data lines D1 to D4, and the scan signals are transmitted to the scan lines S1 to S4, the pixels E11 to E44 emit light.

The controller 204 receives the display data transmitted from an outside device (not shown) to provide the display data to the data driving circuit 206 and the cross-talk preventing circuit 208, and also control the operation of the scan driving circuit 202, the data driving circuit 206 and the cross-talk preventing circuit 208.

The cross-talk preventing circuit 208 includes a current controlling circuit 210 and a current providing circuit 212.

The current controlling circuit 210 is provided with the display data from the controller 204, and then provides the current providing circuit 212 with control signals corresponding to the display data.

The current providing circuit 212 provides the scan lines S1 to S4 with compensating currents according to the control signals transmitted from the current controlling circuit 210.

As a result, the same amounts of the total current passes through each scan line S1 to S4.

In another embodiment, the current providing circuit 212 includes just one current source which provides the scan lines S1 to S4 with currents according to the control signals.

Hereinafter, the method of driving the electroluminescent device of the present invention will be described in detail by presenting an example. Here, it is assumed that the line resistance of each scan line S1 to S4 is 160Ω.

Firstly, the controller 204 receives the display data from the outside device and transmits the received display data to the data driving circuit 206.

Subsequently, the data driving circuit 206 provides the data lines D1 to D4 with first data signals, i.e. first data currents according to first display data transmitted through the controller 204.

As a result, for example, the first data current of 1 mA passes through the first data line D1; the first data current of 1 mA passes through the second data line D2; the first data current of 3 mA passes through the third data line D3; and the first data current of 6 mA passes through the fourth data line D4.

In this case, the cross-talk preventing circuit 208 recognizes in advance from the first display data transmitted from the controller 204 that the current of total 11 mA will pass through the data lines D1 to D4.

Here, the cross-talk preventing circuit 208 can also recognize in advance that the current of 11 mA will pass through the first scan line S1 since the first data currents passing through the data lines D1 to D4 will flow along the first scan line S1 through the pixels E11 to E41.

After that, the cross-talk preventing circuit 208 provides the first scan line S1 with the compensating current of 9 mA. As a result, total 20 mA of current may flow through the first scan line S1.

Next, the data driving circuit 206 provides the data lines D1 to D4 with second data signals, i.e. second data currents according to second display data transmitted through the controller 204.

As a result, for example, the second data current of 2 mA passes through the first data line D1; the second data current of 3 mA passes through the second data line D2; the second data current of 3 mA passes through the third data line D3; and the second data current of 6 mA passes through the fourth data line D4.

In this case, the cross-talk preventing circuit 208 recognizes in advance that the sum of the second data currents, 14 mA of current will flow through the second scan line S2.

After that, the cross-talk preventing circuit 208 provides the second scan line S2 with the compensating current of 6 mA. As a result, total 20 mA of current flows through the second scan line S2.

Namely, in such way as described above, the present invention make it possible that the same amount of current passes through each scan line S1 to S4. As a result, the cathodes of the pixels E11 to E44 have a voltage of 3.2V.

In summary, in the electroluminescent device of the present, the same voltage is applied to the cathode of the pixels E11 to E44 unlike the conventional electroluminescent device where the cathodes of the pixels do not have the same voltage value.

Therefore, in the electroluminescent device of the present invention, the cross-talk problem can be overcome.

Figure 3:
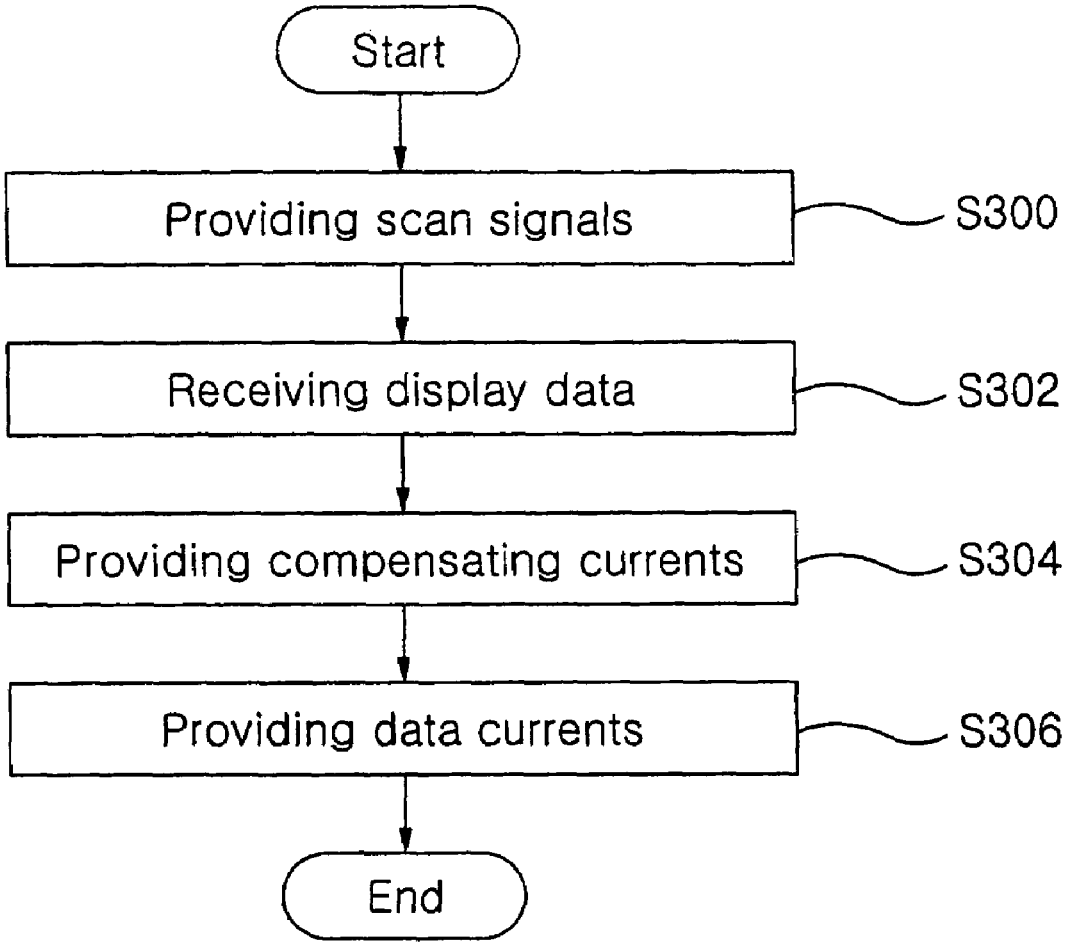
FIG. 3 is a flow chart illustrating a method of driving the electroluminescent device of FIG. 2.

FIG. 3 is a flow chart illustrating a method of driving the electroluminescent device of FIG. 2.

Referring to FIG. 3, the scan driving circuit 202 provides the scan lines S1 to S4 with the scan signals in sequence (S300).

Next, the controller 204 receives the display data transmitted from the outside device (S302).

Subsequently, the cross-talk preventing circuit 208 provides each scan line S1 to S4 with the currents corresponding to the display data (S304).

As a result, the total current passing through each scan line S1 to S4 becomes of the same value.

Next, the data driving circuit 206 provides the data lines D1 to D4 with the data signals corresponding to the display data transmitted from the controller 204 (S306).

As a result, the pixels E11 to E44 come to emit light at a desired luminance without the cross-talk phenomenon.

Figure 4:
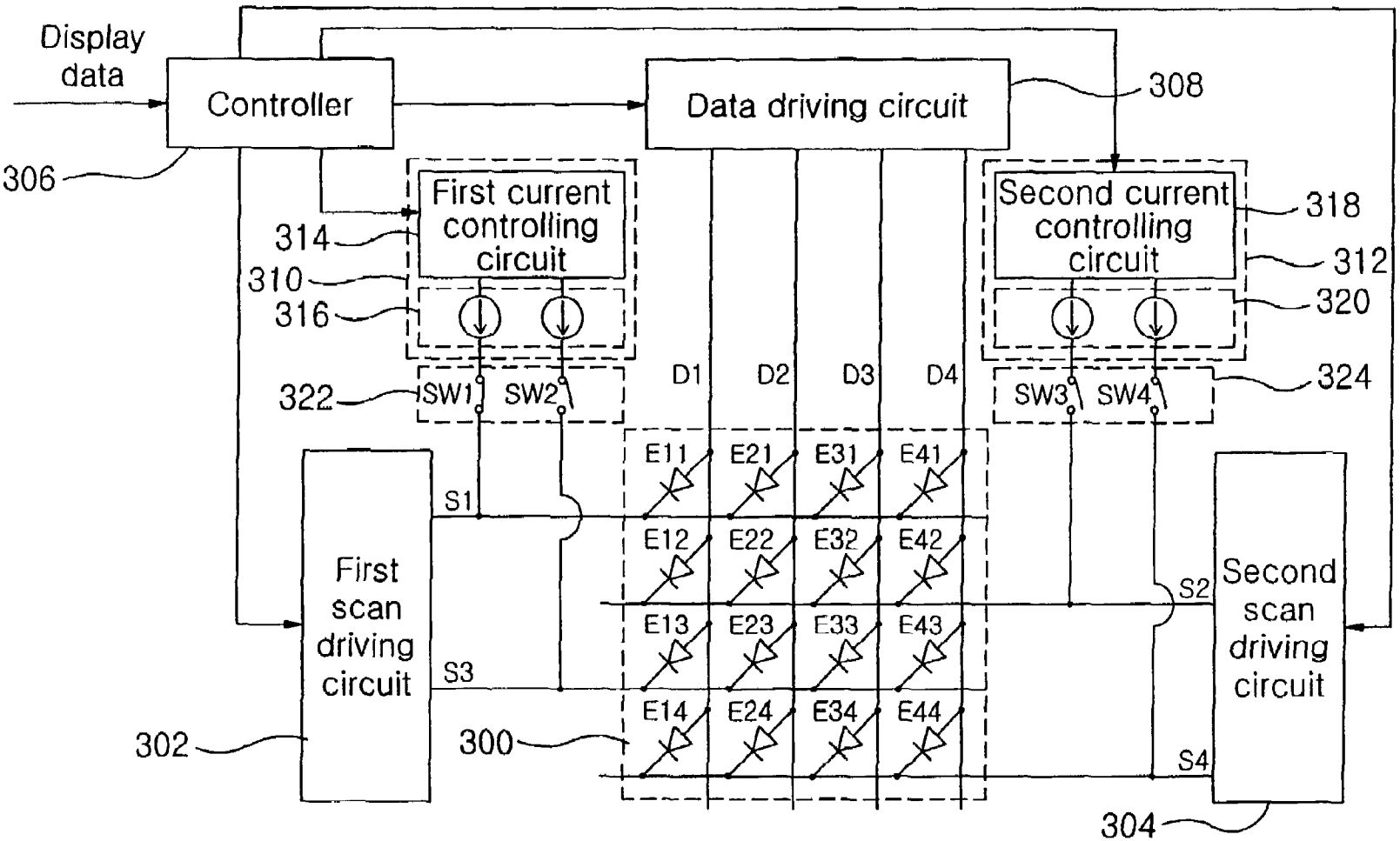
FIG. 4 is a block diagram illustrating an electroluminescent device according to another embodiment of the present invention.

FIG. 4 is a bock diagram illustrating an electroluminescent device according to another embodiment of the present invention.

Referring to FIG. 4, the electroluminescent device of another embodiment of the present invention comprises a panel 300, a first san driving circuit 302, a second san driving circuit 304, a controller 306, a data driving circuit 308, a first cross-talk preventing circuit 310, a second cross-talk preventing circuit 312, a first switching circuit 322 and a second switching circuit 324.

The panel 300 includes a plurality of pixels E11 to E44 that are defined as overlying areas of data lines D1 to D4 and scan lines S1 to S4.

Here, the scan lines S1 to S4 are extended in two directions. In other words, the scan lines S1 to S4 include first scan lines S1 and S3 extended in first direction, and second scan lines S2 and S4 extended in second direction. Furthermore, the first scan lines S1 and S3 are connected to the first scan driving circuit 302, and the second scan lines S2 and S4 are connected to the second scan driving circuit 304.

The first scan driving circuit 302 transmits a plurality of first scan signals to the first scan lines S1 and S3 in sequence.

The scan driving circuit 304 transmits a plurality of second scan signals to the scan lines S2 to S4 in sequence.

The data driving circuit 308 transmits to the data lines D1 to D4 data signals corresponding to display data provided through the controller 306.

When the data signals are transmitted to the data lines D1 to D4 with the scan signals being provided to the scan lines S1 to S4, the pixels E11 to E44 emit light.

The controller 306 receives the display data transmitted from an outside device (not shown) to provide the display data to the data driving circuit 308, the first and the second cross-talk preventing circuits 310 and 312, and also control the operation of the first and second scan driving circuits 302 and 304, the data driving circuit 308 and the first and the second cross-talk preventing circuits 310 and 312.

The first cross-talk preventing circuit 310 includes a first current controlling circuit 314 and a first current providing circuit 316.

The first current controlling circuit 314 is provided with the display data from the controller 306, and then provides the first current providing circuit 316 with first control signals corresponding to the display data.

The first current providing circuit 316 provides the scan lines S1 and S3 respectively with the compensating currents upon receiving the first control signals transmitted from the first current controlling circuit 314.

The second cross-talk preventing circuit 312 includes a second current controlling circuit 318 and a second current providing circuit 320.

The second current controlling circuit 318 is provided with the display data from the controller 306, and then provides the first current providing circuit 320 with second control signals corresponding to the display data.

The second current providing circuit 320 provides the second scan lines S2 and S4 respectively with the compensating currents upon receiving the second control signals transmitted from the second current controlling circuit 318.

As a result, the total current of each scan line S1 to S4 can become of the same value.

In another embodiment, the current providing circuits 316 and 320 include just one current source, which provides the scan lines S1 to S4 respectively with currents according to the control signals.

The first switching circuit 322 switches the connection between the first cross-talk preventing circuit 310 and the first scan lines S1 and S3.

The second switching circuit 324 switches the connection between the second cross-talk preventing circuit 312 and the second scan lines S2 and S4.

For example, in order for the first cross-talk preventing circuit 310 to provide the scan line S1 with the compensating current, the first switch SW1 of the first switching circuit 322 is turned on, in which case the other switches SW2 to SW4 are turned off And, in order for the second cross-talk preventing circuit 312 to provide the scan line S2 with the compensating current, the third switch SW3 of the second switching circuit 324 is turned on, in which case the other switches SW1, SW2 and SW4 are turned off.

Hereinafter, the method of driving the electroluminescent device of the present invention will be described in detail by presenting an example. Here, it is assumed that the line resistance of each scan line S1 to S4 is 160Ω.

Firstly, the controller 306 receives first display data from the outside device and transmits the received display data to the data driving circuit 308.

Subsequently, the data driving circuit 308 provides the data lines D1 to D4 with first data signals, i.e. first data currents according to the first display data transmitted through the controller 308.

As a result, for example, the first data current of 1 mA passes through the first data line D1; the first data current of 1 mA passes through the second data line D2; the first data current of 3 mA passes through the third data line D3; and the first data current of 6 mA passes through the fourth data line D4.

In this case, the first cross-talk preventing circuit 310 recognizes in advance from the first display data transmitted from the controller 306 that total 11 mA of current will pass through the data lines D1 to D4.

Here, the first cross-talk preventing circuit 310 also recognizes in advance that the total 11 mA of current will pass through the scan line S1 since the first data currents passing through the data lines D1 to D4 will flow along the scan line S1 through the pixels E11 to E41.

After that, the first cross-talk preventing circuit 310 provides the scan line S1 with the compensating current of 9 mA. As a result, a total 20 mA of current comes to passé through the scan line S1.

Subsequently, the controller 306 receives second display data from the outside device and transmits the received second display data to the data driving circuit 308.

Then, the data driving circuit 308 provides the data lines D1 to D4 with second data signals, i.e. second data currents according to the second display data transmitted through the controller 308.

As a result, for example, the second data current of 2 mA passes through the first data line D1; the second data current of 3 mA passes through the second data line D2; the second data current of 3 mA passes through the third data line D3; and the second data current of 6 mA passes through the fourth data line D4.

In this case, the second cross-talk preventing circuit 312 recognizes in advance that a total 14 mA of current will pass through the scan line S2.

After that, the second cross-talk preventing circuit 312 provides the scan line S2 with the compensating current of 9 mA. As a result, a total 20 mA of current comes to pass through the scan line S2.

Namely, in such way as described above, the present invention make it possible that the same current passes through each scan line S1 to S4. As a result, the cathodes of the pixels E11 to E44 have a voltage of 3.2V.

In summary, in the electroluminescent device of the present invention, the same voltage is applied to the cathode of the pixels E11 to E44 unlike in the conventional electroluminescent device where the cathodes of the pixels do not have the same voltage value.

Therefore, in the electroluminescent device of the present invention, the cross-talk problem can be overcome.

Figure 5:
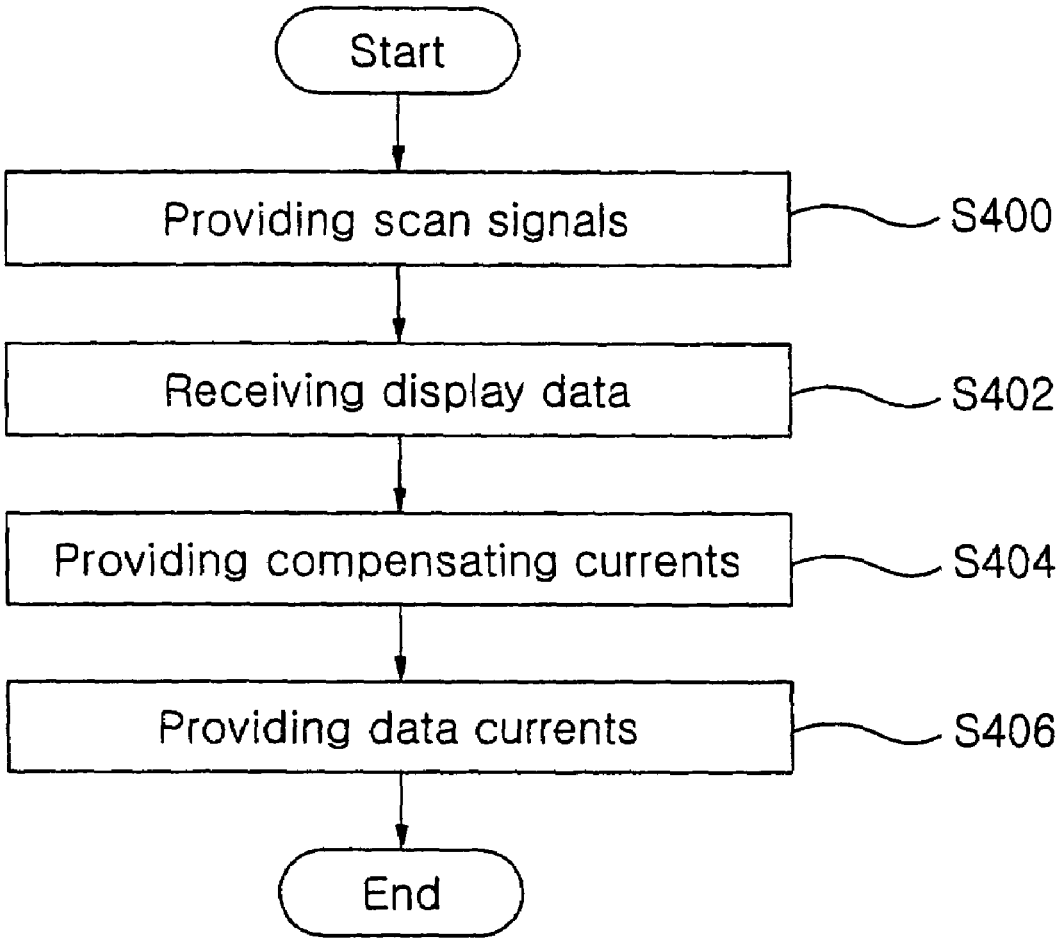
FIG. 5 is a flow chart illustrating a method of driving the electroluminescent device of FIG. 4.

FIG. 5 is a flow chart illustrating a method of driving the electroluminescent device of FIG. 4.

Referring to FIG. 5, the first and second scan driving circuits 302 and 304 provide the scan lines S1 to S4 with the first and second scan signals in sequence (S400).

Next, the controller 306 receives the display data transmitted from the outside device (S402).

Subsequently, the first and second cross-talk preventing circuits 310 and 312 provide each scan line S1 to S4 with the compensating currents corresponding to the display data (S404).

As a result, the total current passing through each scan line S1 to S4 becomes of the same value.

Next, the data driving circuit 308 provides the data lines D1 to D4 with the data signals corresponding to the display data transmitted from the controller 306 (S406).

As a result, the pixels E11 to E44 come to emit light at a desired luminance without the cross-talk phenomenon.

What is claimed is:

1. A light emitting device, comprising:

display panel including:

a plurality of scan lines disposed in a first direction;

a plurality of data lines disposed in a second direction, wherein the second direction is different from the first direction; and a plurality of pixels that are defined as overlying areas of the plurality of scan lines and the plurality of data lines; and a cross-talk preventing circuit configured to provide the plurality of scan lines with compensating currents according to display data provided by an outside device, wherein a total current flowing through each scan line has the same value, and wherein the total current is a sum of the compensating currents and data currents passing through the data lines.

2. The light emitting device of claim 1, wherein the cross-talk preventing circuit comprises:

a current controlling circuit configured to generate control signals according to the display data provided by the outside device; and a current providing circuit configured to provide the plurality of scan lines with the compensating currents according to the control signals transmitted from the current controlling circuit.

3. The light emitting device of claim 1, further comprising:

a scan driving circuit configured to transmit scan signals to the plurality of scan lines;

a data driving circuit configured to provide the plurality of data lines with data currents synchronized with the scan signals; and a controller configured to control the cross-talk preventing circuit, the scan driving circuit and the data driving circuit.

4. The light emitting device of claim 1, wherein the light emitting device is an organic electroluminescent device.

5. The light emitting device of claim 1, wherein a same voltage is applied to a cathode of the plurality of pixels.

6. A light emitting device, comprising:

a display panel including:

a plurality of scan lines including a plurality of first scan lines extending in a first direction and a plurality of second scan lines extending in a second direction;

a plurality of data lines disposed to cross with the plurality of scan lines; and a plurality of pixels that are defined as crossing areas of the plurality of scan lines and the plurality of data lines; and a cross-talk preventing circuit configured to provide the plurality of scan lines with compensating currents according to display data provided by an outside device, wherein a total current flowing through each scan line has the same value, the cross-talk preventing circuit including:

a first cross-talk preventing circuit electrically coupled to the plurality of first scan lines and configured to provide the plurality of first scan lines with the compensating currents; and a second cross-talk preventing circuit electrically coupled to the plurality of second scan lines and configured to provide the plurality of second scan lines with the compensating currents, and wherein the total current is a sum of the compensating currents and data currents passing through the data lines.

7. The light emitting device of claim 6, wherein the first cross-talk preventing circuit comprises:

a first current controlling circuit configured to generate first control signals according to the display data provided by the outside device; and a first current providing circuit configured to provide the plurality of first scan lines with the compensating currents according to the control signals transmitted from the first current controlling circuit.

8. The light emitting device of claim 7, wherein the second cross-talk preventing circuit comprises:

a second current controlling circuit configured to generate second control signals according to the display data provided by the outside device; and a second current providing circuit configured to provide the plurality of second scan lines with the compensating currents according to the control signals transmitted from the second current controlling circuit.

9. The light emitting device of claim 6, further comprising:

a first switching circuit configured to selectively connect the first cross-talk preventing circuit to the plurality of first scan lines; and a second switching circuit to selectively connect the second cross-talk preventing circuit to the plurality of the second scan lines.

10. The light emitting circuit of claim 6, further comprising:

a first scan driving circuit configured to transmit first scan signals to the plurality of first scan lines;

a second scan driving circuit configured to transmit second scan signals to the plurality of second scan lines;

a data driving circuit configured to provide the plurality of data lines with data currents synchronized with the scan signals; and a controller configured to control the cross-talk preventing circuit, the first scan driving circuit, the second scan driving circuit and the data driving circuit.

11. The light emitting device of claim 6, wherein the light emitting device is an organic electroluminescent device.

12. The light emitting device of claim 6, wherein a same voltage is applied to a cathode of the plurality of pixels.

13. A method of driving a light emitting device including a plurality of pixels that are defined as overlying areas of a plurality of scan lines and a plurality of data lines, the method comprising:

receiving display data provided by an outside device; and providing the plurality of scan lines with compensating currents according to the received display data, wherein a total current flowing through each scan line has the same value, and wherein the total current is a sum of the compensating currents and data currents passing through the data lines.

14. The method of claim 13, wherein providing the plurality of scan lines with compensating currents according to the received display data comprises:

generating control signals according to the received display data; and providing each scan line with the compensating currents according to the control signals.

15. The method of claim 13, further comprising:

transmitting scan signals to the plurality of scan lines; and providing the plurality of data lines with data currents corresponding to the received display data.

16. The method of claim 13, wherein the light emitting device is an organic electroluminescent device.

17. The method of claim 13, wherein a same voltage is applied to a cathode of the plurality of pixels.

18. A method of driving a light emitting device including a plurality of pixels that are defined as overlying areas of a plurality of scan lines including a plurality of first scan lines and a plurality of second scan lines and a plurality of data lines, the method comprising:

receiving display data provided by an outside device;

providing the plurality of first scan lines with compensating currents according to the received display data; and providing the plurality of second scan lines with the compensating currents according to the received display data, wherein a total current flowing through each scan line has the same value, and wherein the total current is a sum of the compensating currents and data currents passing through the data lines.

19. The method of claim 18, wherein providing the plurality of first scan lines with compensating currents according to the received display data comprises:

generating first control signals according to the received display data; and providing the plurality of first scan lines with the compensating currents according to the first control signals.

20. The method of claim 18, wherein providing the plurality of second scan lines with the compensating currents according to the received display data comprises:

generating second control signals according to the received display data; and providing the second scan lines with the compensating currents according to the second control signals.

21. The method of claim 18, further comprising:

transmitting first scan signals to the plurality of first scan lines;

transmitting second scan signals to the plurality of second scan lines; and providing the plurality of data lines with data currents corresponding to the received display data.

22. The method of claim 18, wherein the light emitting device is an organic electroluminescent device.

23. The method of claim 18, wherein a same voltage is applied to a cathode of the plurality of pixels.

* * * * *